US005309859A

United States Patent [19]

Miller

[11] Patent Number: 5,309,859

[45] Date of Patent: May 10, 1994

[54] HYDROFOIL DEVICE

[76] Inventor: Richard T. Miller, 1521 Posen Ave., Albany, Calif. 94706

[21] Appl. No.: 46,150

[22] Filed: Apr. 13, 1993

[51] Int. Cl.[5] ..... B63B 1/24

[52] U.S. Cl. ..... 114/274; 114/39.2; 114/280

[58] Field of Search ..... 114/39.2, 274–282; 441/74

[56] References Cited

U.S. PATENT DOCUMENTS

| | | | |
|---|---|---|---|
| 1,852,680 | 4/1932 | Shaw | 114/274 |
| 2,890,672 | 6/1959 | Boericke, Jr. | 114/274 |
| 3,421,468 | 1/1969 | Newsom | 114/274 |
| 3,742,890 | 7/1973 | Hubbard et al. | 114/274 |
| 3,804,048 | 4/1974 | Cline | 114/274 |
| 3,915,106 | 10/1975 | De Witt | 114/274 |
| 3,946,688 | 3/1976 | Gornstein et al. | 114/274 |
| 3,999,496 | 12/1976 | Mirande | 114/280 |
| 4,508,046 | 4/1985 | Coulter et al. | 114/39.2 |
| 4,517,912 | 5/1985 | Jones | 114/275 |
| 4,579,076 | 4/1986 | Chaumette | 114/275 |
| 4,715,304 | 12/1987 | Steinberg | 114/39.2 |
| 4,949,919 | 8/1990 | Wajnikonis | 244/35 R |
| 5,022,337 | 6/1991 | Caldwell | 114/39.2 |

FOREIGN PATENT DOCUMENTS

| | | | |
|---|---|---|---|
| 3130554 | of 1983 | Fed. Rep. of Germany . | |
| 2313254 | 2/1977 | France | 114/278 |

OTHER PUBLICATIONS

Lewis, B., The Harken Hydrofoil, Harken Vanguard News, Summer, 1985, pp. 17–19.

Dobay, Proceedings of the Hydrofoil Symposium, Society of Naval Architects and Marine Engineers, spring, 1965. pp. f1–f12.

French, et al, Proceedings of the Hydrofoils and Air Cushion Vehicles meeting, Washington, D.C., Sep. 17–18, 1962. pp. 23–34.

Shen, Y., & Epler, R., Wing sections for hydrofoils, Journal of Ship Research, Sep. 1979, pp. 209–217, & Sep. 1981, pp. 191–200.

*Primary Examiner*—Jesus D. Sotelo

[57] ABSTRACT

A hydrofoil sailboard comprising a conventional sailboard, without the usual tail skeg, equipped with two hydrofoils arrayed in a canard configuration, the combined lift of the foils being sufficient to hold the board clear of the water at operational speeds. The main foil, mounted beneath the rear of the board is designed to ride fully submerged and to support the bulk of the weight of the board and sailor. The much smaller canard foil, mounted beneath the front of the board is designed to ride at or near the water surface, and its purpose is control and balance. The main foil is connected to the board by a supporting foil which is provided with ventilation fences. The canard is rigidly connected to the board by a support comprising a rod about which a streamlined fairing is free to swivel. A seal between the fairing and the rod prevents airflow to the canard along the inside of the fairing. The purpose of the swiveling fairing is to eliminate canard ventilation along the outside of the support, to reduce drag, and to enhance steering. The canard is designed to rapidly shed air bubbles that may lodge on it when it is submerged.

8 Claims, 12 Drawing Sheets

HYDROFOIL DEVICE

BACKGROUND

1. Field of Invention

This invention relates to hydrofoils, and to sailboards, specifically to those equipped with hydrofoils which are capable of lifting the board clear of the water surface.

2. Description of Prior Art

Hydrofoils are appended to sailboards for the purpose of increasing speed or improving handling characteristics, or both. Higher speed comes essentially for free, since submerged hydrofoils can easily provide adequate lift while operating at much lower drag than planing hulls. The problem in the design of hydrofoil sailboards is that of providing rapid automatic corrective response to a number of destabilizing hydrodynamic effects, so that the sailor is able to control the craft. Automatic height control in waves is particularly important.

Providing this automatic response has proven so difficult, that despite widespread speculation among board sailors about hydrofoil sailboards, only a few patents have been issued and there is currently no example on the market. The typical board sailor has never seen hydrofoils actually attached to a sailboard.

I have found four prior designs for sailboard hydrofoils: two are disclosed in U.S. Pat. Nos. 4,508,046 (1985) to Coulter et al. and 4,715,304 (1987) to Steinberg, one is disclosed in German patent 3,130,554 Al (1983) to Jankowski, and one was manufactured by the Harken Company without patent. These designs cover the range of known hydrofoil configurations. Each has significant drawbacks which I shall discuss presently.

In contrast to the sparse hydrofoil sailboard prior art, that for other (larger) types of hydrofoil craft is extensive. Basic engineering is well covered; such topics as attitude stability, altitude determination, lateral force balance, and turning, at least in the absence of important surface effects, are completely developed. The subject of foil ventilation has been heavily researched. Much of this knowledge can be applied to hydrofoil sailboards.

However, the most vexing questions for the hydrofoil sailboard designer are not addressed in the art of other craft, as they derive expressly from two features of hydrofoil sailboards which distinguish such sailboards from larger hydrofoil craft.

First, by the nature of the sport, control must be obtained by simple operator movements, and preferably by mere weight shifts and sail position manipulations. Thus, much of the panoply of modern techniques for controlling larger hydrofoils, which involves active, powered, often computed, sensing and feedback to drive hydrodynamic flaps or pneumatic valves, is not available to the hydrofoil sailboard designer. In particular, hydrofoil sailboard stabilization must come readily from the interaction of hydrodynamic forces, operator and board mass forces, and board and foil configuration.

Second, there is the fact that sailboards are so small. Consequently, foils for them must necessarily operate very close to the water surface. In waves, proximity between the foils and the surface implies that sailboard hydrofoils penetrate the water surface as a matter of course, and even in flat water, such proximity leads to instabilities that do not exist for foils operating more deeply submerged. For instance, ventilation is a severe problem even for fully submerged hydrofoil configurations—a problem to which larger craft are resistant. Broaching—the movement of a foil through the water surface from below—is another problem. Broaching has severe hydrodynamical implications, and graceful recovery after broaching is crucial to successful design. The specific difficulty for small hydrofoil craft derives from the fact that a foil, having just broached and resubmerged, often carries down with it an air bubble stuck to its top surface. This bubble seriously reduces the lift produced by the foil compared to the lift produced at the same depth in the absence of the bubble. Typically, the result of this loss of lift is a radical sinking of the affected foil, which continues until either the bubble sheds spontaneously or the board itself hits the water. I call this phenomenon plunging.

All control problems in hydrofoil sailboards, and especially that of height maintenance, are exacerbated by the need for very quick correction, before the board falls the small distance from its normal operating height to the wave crests.

I now turn to specific hydrofoil art that relates to features of the present invention. I begin with knowledge related to the ability of a foil to track the water surface. Such tracking is useful in itself, but is more often used to control one or more other foils.

It has long been known that proximity to the water surface modifies the behavior of a fully submerged hydrofoil. To a first approximation, it loses lift as it approaches the surface. This effect is significant at depths of less than a chord length or so. It can be used in suitable circumstances to stabilize foil depth. It is called, simply, the surface effect. A whole class of flat water hydrofoil ferries have been built based on the surface effect.

It is also known that, in flat water, a hydrofoil can operate so as to remain on, or just slightly below the water surface. This mode of operation is called hydroplaning. It is characterized by the fact that the foil top surface is largely or completely exposed to the open air. There is conflicting evidence available on the effect of depth on lift, and hence, on the height stability of a hydroplaning foil. Certainly there is some range in which lift increases with depth, since hydroplaning is observed in practice. At greater depth, this situation may reverse. At best, the situation is not clearly understood. I have found two academic papers that mention the problem. One is work of Dobay on surface ventilation in the proceedings of the Hydrofoil Symposium held at the 1965 spring meeting of the Society of Naval Architects and Marine Engineers, and the other is by French et al. in the Proceedings of the Hydrofoils and Air Cushion Vehicles meeting, Washington, D.C., Sep. 17-18, 1962.

It is generally believed that for a foil operating at a given speed, angle of attack, and depth, it will develop far less lift if it is hydroplaning than if is fully submerged. Consequently, the expectation is frequently voiced that there should be an equilibrium depth where a foil can remain, suspended as it were, between hydroplaning and fully submerged. This logic is faulty. Hydrodynamics does not provide any basis for the expectation that there is a stable state between the two separate and distinct states. Which state prevails at any given moment depends on the previous history. In practice this often leads to very erratic behavior. Erratic behavior, of course, is precisely the opposite of what is wanted for control. On the positive side, since hydroplaning is unknown below very shallow depths, generally thought to be of the order of one chord at least the vertical amplitude of motion of a foil alternating between hydroplaning and fully submerged is limited.

The plunging phenomenon described earlier is a worsening of the erratic behavior discussed in the previous paragraph. Plunging involves, in addition to hydroplaning and full submerged, a third foil state in which the top surface is not exposed to the open air, but rather, to air enclosed in a compact volume, which I called a bubble. The new feature, the attached bubble, which can exist at considerable depth, greatly increases the possible vertical amplitude of motion of a foil that experiences all three states of surface wetting. A plunging foil is useless for control.

I have found one prior description of plunging. It is in U.S. Pat. No. 4,517,912 (1985) to Jones. Jones discloses a control means for hydrofoils for a sailing catamaran in which the attitude of a main foil is to be controlled by the depth of submersion of a smaller sensing foil, in consequence of which, the depth of the main foil, and hence the height of the craft itself, are kept constant. He notes in a single paragraph, that in chop, as the sensing foil approaches the surface, the water flow on its upper surface separates, decreasing the foil lift and causing it to dive. He then notes that what he calls the separated cavity tends to hang on to the foil, and that the foil continues to drop. He does not attempt to resolve the difficulty posed by the cavity.

U.S. Pat. No. 4,579,076 (1986) to Chaumette discloses a mechanism similar to Jones' for automatic height regulation of individual hydrofoil elements. In both devices, because of the short horizontal distance between the sensing foil and the foil it controls, control will tend to be abrupt. This abruptness will become especially acute in waves.

Jones states that his sensing foil should track at a small depth below the surface. He bases his analysis on the incorrect equilibrium depth expectation which I mentioned above.

Chaumette states that his sensing foil would track the surface itself, arguing simply that when the foil is in the air the lift would be negative, and when it is submerged it would be positive, and so in between there would be an equilibrium.

Because of plunging, neither Jones' nor Chaumette's sensing foil will stably track the surface.

Theoretical considerations associated with bubble attachment and shedding may be related to those associated with the high speed phenomenon of cavitation. I have found U.S. Pat. Nos. 3,946,688 (1976) to Gornstein, 4,949,919 (1990) to Wajnikonis, and 5,022,337 (1991) to Caldwell that speak to ventilation and cavitation. In addition, there is a considerable academic literature on these phenomena. Calculations of cavitation resistant foil sections are given by Shen and Eppler in the Journal of Ship Research, Vol 23, No 3, Sep. 1979, pp 209-217, and Vol 25, No 3, Sep. 1981, pp 191-200. However, in none of this work have I found any discussion specifically about foils that do not form air bubbles or that shed them rapidly if they form.

I next describe prior art related to yaw and roll stability, and to steering.

U.S. Pat. No. 3,742,890 (1973) to Hubbard contains an excellent discussion of the theory of yaw stability and turning for hydrofoil craft. In the context of a small ship, the patent discloses a modification of a canard configured hydrofoil craft that leads to improved steering during takeoff and in waves. The improvement is effected by use of a rigidly joined canard and streamlined support assembly that pivots on a bearing at the junction of the support and the ship hull in such a way that the support is able to swivel freely into alignment with the incident water flow.

U.S. Pat. No. 3,804,048 (1974) to Cline discloses a method for roll stabilization, which in Cline's embodiment is the same physical device as disclosed in Hubbard.

Both these disclosures are silent on the possible effect that the free trailing of the canard assembly might have on ventilation, either of the canard foil, or of the support.

U.S. Pat. No. 3,999,496 (1976) to Mirande discloses another modification of the standard canard assembly, in which the canard foil and support are, as is usual, rigidly attached to the watercraft hull, but where the support is surrounded by a streamlined fairing mounted on bearings so that the fairing can rotate around the support. Mirande's disclosure pertains to large hydrofoil ships, and the rotating fairing is specifically meant to be power actuated as a means of steering. The disclosure contains a critique of the prior steering art, including Hubbard's device, in which Mirande concludes that force requirements of known steering methods would be too great for application to large ships. Mirande makes no mention of the possibility that the fairing be left free to trail.

U.S. Pat. No. 3,421,468 (1969) to Newsom discloses a pedal powered watercraft that includes a sort of bow rudder that apparently comprises a fairing that rotates on a support. Here, too, no mention is made of possible benefit from free trailing.

Finally, I turn to the prior hydrofoil sailboard art itself. Of the four designs listed previously, only one, Coulter et al, deals adequately with the issue of height control or addresses the problems associated with ventilation, and that design has drawbacks that severely degrade performance.

Coulter et al. use a tandem pair of surface piercing hydrofoils, which control height automatically as a function of speed. These surface piercing foils also provide automatic roll stability. However, surface piercing foils in general have a number of disadvantages compared to fully submerged lifting foils: wave-making resistance where the foils pierce the surface is significant; ventilation of the lifting portions of the foils by air flow from the surface along the diagonal foil members must be blocked, usually by fences, which add drag; the same well known hydrodynamic considerations that lead to the height control and roll stability also lead to a rough ride in waves. This last is a significant problem in the context of a hydrofoil sailboard, since one of the great potential performance advantages, a very smooth ride in moderate sized waves, is lost at the outset. This advantage is realisable only with submerged, or submergible, foils. Coulter's design has another more specific problem, which becomes overwhelming in waves: if the tandem foils are mounted close together as illustrated in his disclosure, pitch stability becomes insufficient; if the foils are spread wider apart fore and aft, steering becomes impossible since each of the four surface piercing foil regions has a continually varying degree of immersion and consequent varying response to yaw.

The Harken Company offered a hydrofoil conversion kit for conventional windsurfers, but it did not catch on and was withdrawn from the market. This kit consisted of a main lifting foil and a pair of smaller, auxiliary lifting foils attached to the main foil by a fuselage mounted substantially parallel with the board. The main foil was attached to a streamlined strut that was inserted into the daggerboard slot of the windsurfer. There was no automatic height control at all, and successful operation required the sailor to make constant attitude adjustments to keep the foils properly submerged. When the sailor failed to do this, the foils alternately broached the surface into the air and crashed back into the water in a cyclical instability called porpoising. (Porpoising is a much less subtle instability than the plunging analysed previously, although both result in the inability of the sailor to control the craft. Porpoising behavior might well be complicated by a degree of plunging.) Avoiding porpoising turned out to be too great an effort for enjoyable long term use of the board.

The patent of Steinberg discloses an airplane foil configuration but implements no automatic height control, and so like the Harken design, is liable to porpoising. Steinberg's disclosure emphasises mechanical means for swiveling, pivoting, or hinging the foils to allow them to be positioned for attitude stability and to be retracted from the operational position.

In addition to ignoring height control, both the Harken design and Steinberg's take no precautions against the various difficulties associated with foil ventilation.

One embodiment of the disclosure of Jankowski is a canard design with the canard mounted on a thin rod and the main foil on a streamlined strut. The canard is about half the size of the main foil. The supports for main foil and canard are substantially the same length, and the foils are mounted on these supports at the same attack angle, which according to the disclosure is meant bring both main and canard to the surface at sufficiently high speed. At still higher speeds, Jankowski envisions rolling the board and foils to reduce wetted surface, and thus drag. This embodiment has some attractive features, but fails in the details necessary to make a stably workable craft.

Since the foils are supposed to fly on the water surface, the design would, of course, if it worked as described, provide height control.

A minor problem with the design as disclosed is that Jankowski's insistence on mounting the main and canard at the same attack will lead to attitude instability when both foils are submerged. This can easily be corrected by increasing the attack of the canard beyond that of the main.

More significantly, the design overlooks the problems of ventilation of foils operating at or near the water surface. The most obvious of these is that, before take off, when the canard is still submerged, the thin rod that supports it provides a perfect ventilation path, running along its trailing stagnation line, to the canard. The resulting ventilation of the top of the canard severely reduces its lift, and, since the main lifting foil with its streamlined support and absence of fences will suffer ventilation as a rather poorly determined function of yaw, the resulting system will suffer eratic losses and resumptions of pitch stability. If the foils are somehow brought to the surface, they will not stay there. Penetration of even a small wave will cause the canard to dive. Some means of blocking this ventilation path along the canard support is necessary.

As with all the prior hydrofoil sailboard designs, Jankowski does not recognize nor circumvent plunging.

In addition to these ventilation problems, which prevent steady operation of Jankowski's hydrofoil as disclosed, his design is liable to an entirely independent disadvantage stemming from the fact that both lifting foils are meant to operate on the water surface. Since hydrofoils are most efficient when flown substantially submerged, he must pay a considerable price in increased drag and consequent lessened speed relative to what would be possible if one or both foils were kept submerged. We shall discuss this issue further in subsequent sections of the disclosure.

The reason that Jankowski uses a thin rod to support the canard rather than the more obvious streamlined strut is unexplained in the disclosure. A good reason, however, is known in the prior art, and is discussed, for example, by Hubbard. It is that the rod provides relatively little lateral force when the board yaws, hence does not interfere with the normal steering control and yaw stabilization that comes with an aft location of the center of lateral resistance.

Jankowski clearly means to use the main and canard foils primarily for lift, and he discloses a daggerboard and skeg combination to balance lateral sail force. This leads to other problems since these vertical foils, exposed to the air after board takeoff, will ventilate. This must be prevented. His notion of rolling the board (presumably to windward) at higher speed would have the effect of unloading the originally vertical foils and transferring a portion of their lift to the main and canard. The daggerboard 12 shown in FIG. 1 of Jankowski becomes superfluous when the lateral resistance is provided by rolling the board.

Thus, all of the hydrofoil sailboard prior art suffers from one or more of the following deficiencies:

(a) poor pitch stability
(b) lack of automatic height control;
(c) poor steerability;
(d) poor yaw stability;
(e) poor roll stability;
(f) succeptibility to foil ventilation;
(g) severely degraded behavior in waves;
(h) low foil efficiency.

Even in the more general hydrofoil prior art, the important topic of air bubble shedding and its relation to foil plunging is not addressed to any useful degree.

SUMMARY OF THE INVENTION

In its preferred embodiment, the invention comprises a conventional sailboard, without the usual tail skeg, equipped with two hydrofoils arrayed in a canard configuration whose combined lift is sufficient to hold the board clear of the water at operational speeds. The main foil, mounted beneath the rear of the board, is designed to fly fully submerged and to support the bulk of the combined weight of the board and rider. The much smaller, so called canard foil, mounted beneath the bow of the board, is designed to fly at or near the water surface and its purpose is control and balance. The main foil is connected to the board by a pair of supporting foils, mounted symmetrically about the board centerline, and provided with ventilation fences. The canard is rigidly connected to the board by a support comprising a rod about which a streamlined fairing is free to swivel. A seal between the fairing and the rod prevents air flow to the canard along the inside of the fairing. The canard is designed to inhibit plunging.

In operation, the canard tracks the water surface. This causes the main foil to automatically trail at a submerged depth that is a function of the board speed and its loading. Because of the great fore and aft distance between the canard and the main, the craft is very stable in pitch.

When the canard is submerged, which is the case before takeoff and which happens in waves, the sealed, swiveling fairing eliminates canard ventilation along the canard support, and reduces drag. In combination with the fixed main support foils it provides stable yaw behavior, which enhances steering.

As with conventional sailboards, all maneuvers can be accomplished by shifting the rider's weight and the position of the sail.

OBJECTS AND ADVANTAGES

Accordingly, an object of the present invention is to provide a hydrofoil assembly for a watercraft which sheds air bubbles quickly so plunging is inhibited.

Another object of the present invention is to provide a hydrofoil assembly for a watercraft which tracks the water surface reliably.

Another object of the present invention is to provide a canard hydrofoil assembly for a watercraft which has a streamlined support that is free to conform to the water flow so that roll and yaw stability of the watercraft are enhanced, steering is improved, and canard hydrofoil ventilation by air flow along the canard support is inhibited.

Another object of the present invention is to provide a canard hydrofoil assembly for a watercraft that is simple to manufacture and reliable to use.

Another object of the present invention is to provide a main hydrofoil assembly that inhibits ventilation of the main supports and the main hydrofoil.

Other objects of the present invention are to provide a canard configured hydrofoil sailboard which has an efficient main hydrofoil, which has a canard hydrofoil that may be lightly loaded during operation, which rides smoothly in small and medium waves, and which has graceful broaching behavior so performance in large waves is remains good.

Taken together, the above objects lead to the prime object of the present invention which is to provide the low drag and consequent high speed possible with hydrofoil supported craft while maintaining the desirable performance and control characteristics of the current generation of sailboards.

Further objects and advantages of my invention will become apparent from a consideration of the drawings and ensuing description.

Figure 1:
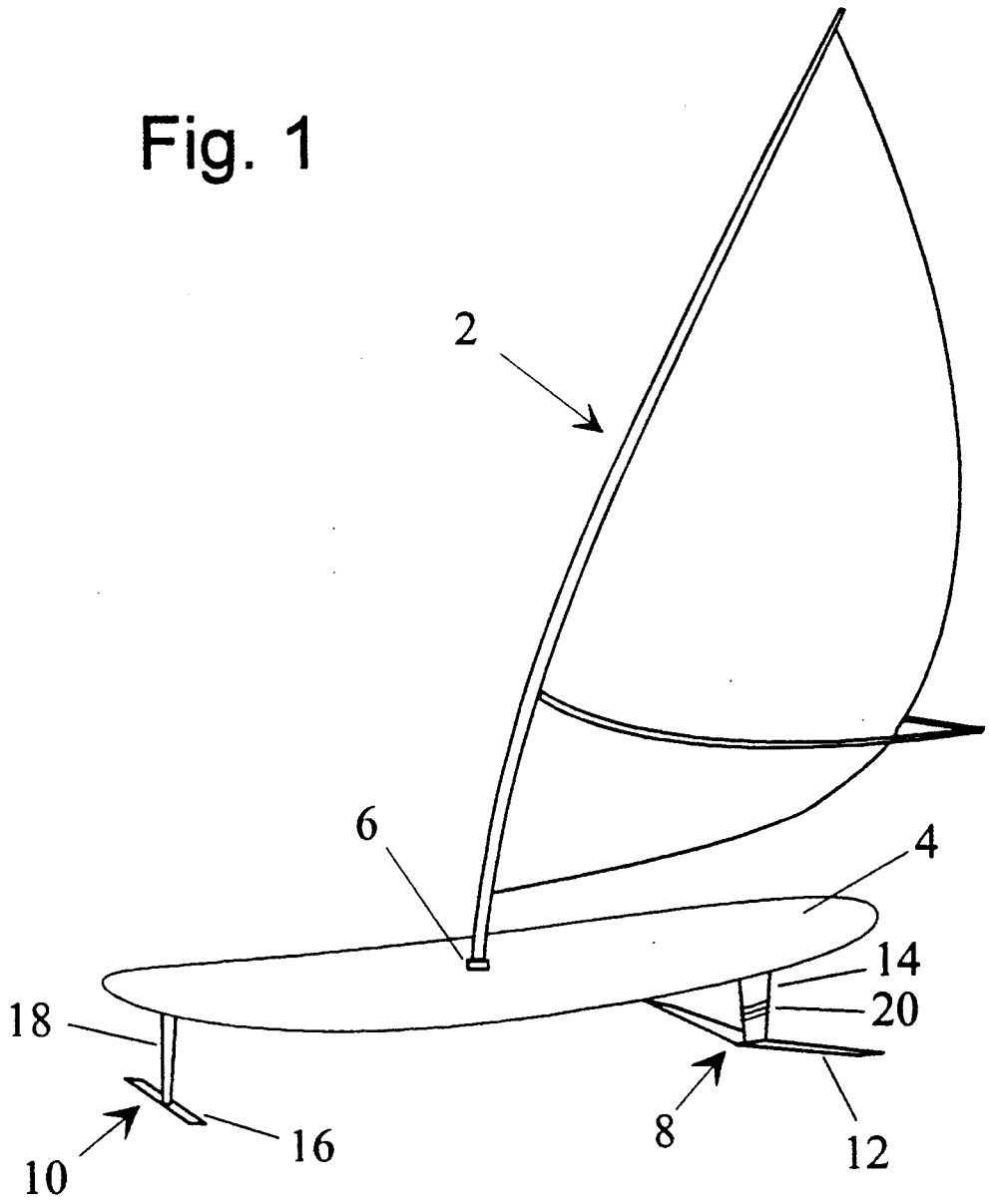
FIG. 1 is a perspective view from the side and above of a canard configured hydrofoil sailboard having a single main support.

The drawings diagrammatically illustrate by way of example, not by way of limitation, preferred forms of the present invention.

REFERENCE NUMERALS IN DRAWINGS

2 sail assembly
4 board
6 universal joint
8 main hydrofoil assembly
10 canard hydrofoil assembly
12 main hydrofoil
14 main support
16 canard hydrofoil
18 canard support
20 main support ventilation fences
22 canard support rod
24 streamlined fairing
26 seal
28 preferred profile
30 trailing edge flap
32 bubble shedding protrusion
34 bubble shedding fence
36 flicking mechanism
38 flexible streamlined fairing
40 air passage
42 air intake
44 bearing
46 shaft

DESCRIPTION OF THE PREFERRED EMBODIMENT

FIG. 1 shows a perspective view of my hydrofoil sailboard. A sail assembly 2 is connected to the upper side of a hull or board 4 by means of a universal joint 6. A main hydrofoil assembly 8 is mounted on the lower side of board 4 near its after end, and a canard hydrofoil assembly 10 is mounted on the lower side of board 4. Assembly 8 comprises a main hydrofoil 12 connected to board 4 by a main support 14. Assembly 10 comprises a canard hydrofoil 16 connected to board 4 by a canard support 18. The hydrofoils are arranged in an extreme canard configuration, that is, with main foil 12 much larger than canard foil 16. Main support 14 is longer than canard support 18. Thus, when the board is positioned upright and substantially horizontally as shown in FIG. 1, main foil 12 is lower than canard foil 16. Main support 14 is provided with a number of ventilation fences 20*a*, 20*b*, and 20*c*. Supports 14 and 18 are shaped and sized at their upper ends to fit into standard heavy-duty sailboard fin boxes (not shown) that are let into board 4. A mast foot universal slot (not shown) is let into board 4 to receive universal joint 6. The slot is positioned further aft than is usual for conventional sailboards.

Figure 8:
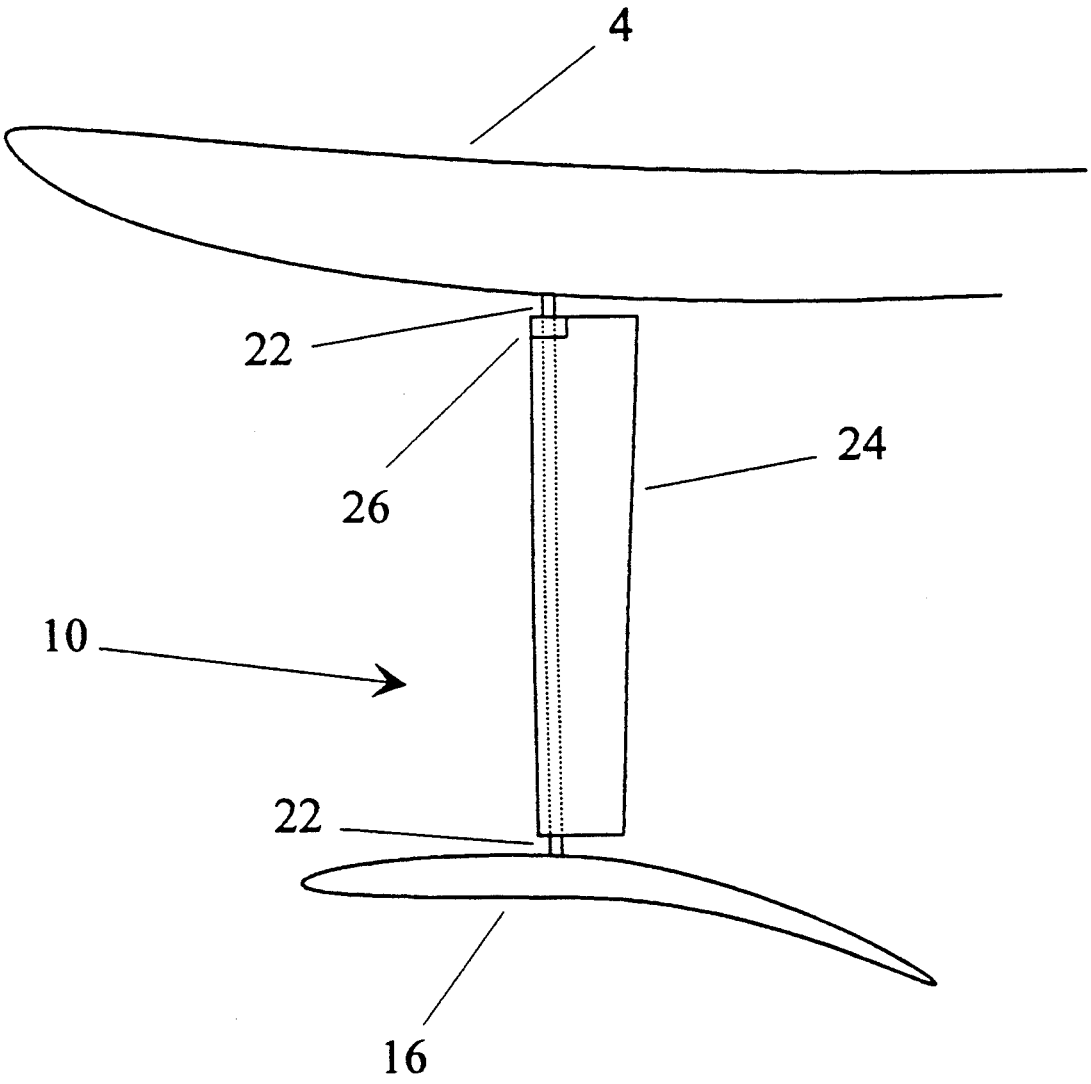
FIG. 8 is a side view of a canard hydrofoil assembly showing a swiveling fairing on a support rod.

FIG. 8 shows a side view of canard assembly 10. A canard support rod 22 connects to canard hydrofoil 16. A streamlined fairing 24 is free to swivel on rod 22. Attached to the top of the canard fairing is a seal 26 that fits snuggly around rod 22.

Figure 9:
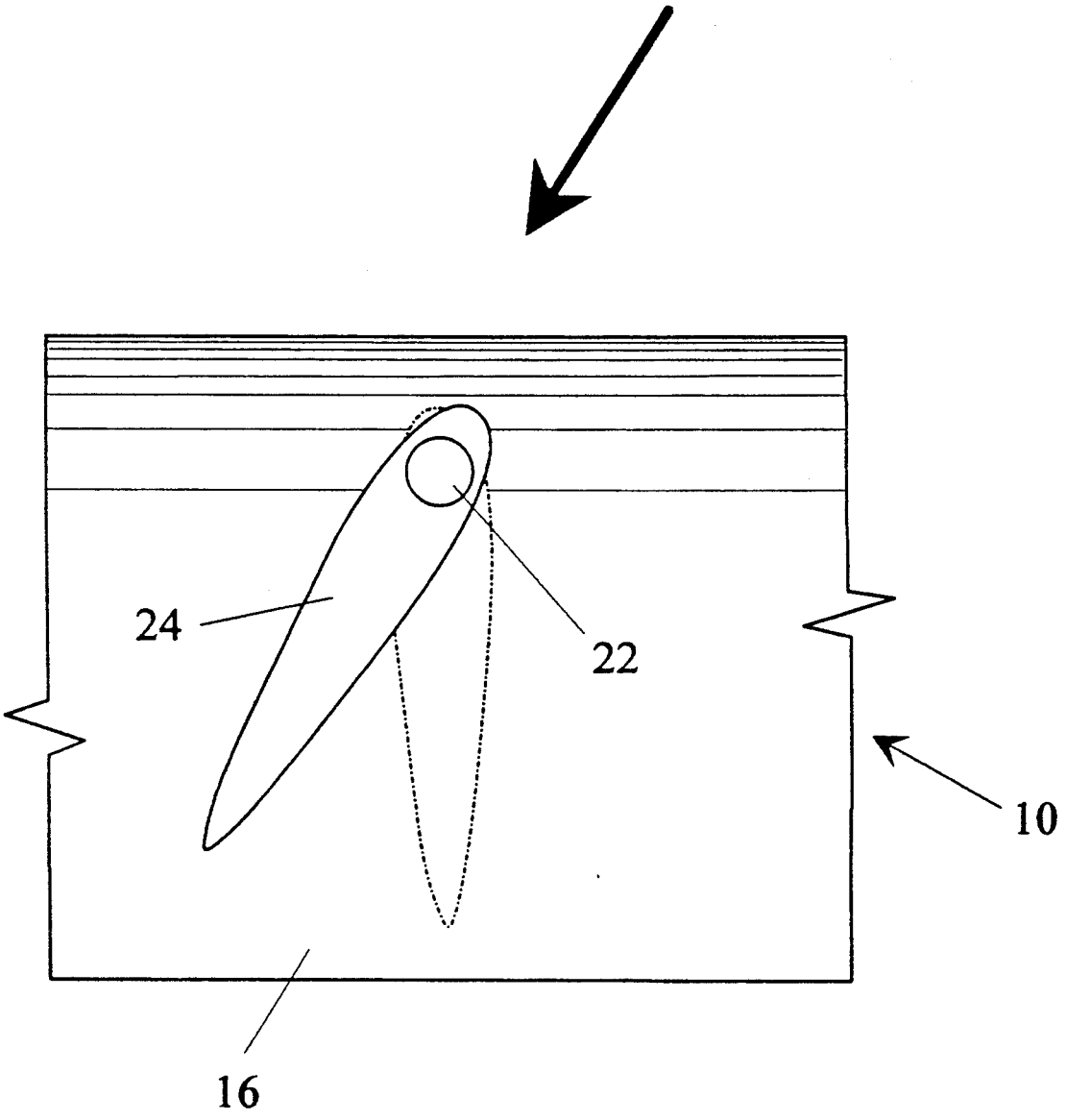
FIG. 9 is a top view of a the assembly shown in FIG. 8.

FIG. 9 shows a top view of assembly 10. It indicates fairing 24 in both swiveled and straight attitudes.

Figure 3:
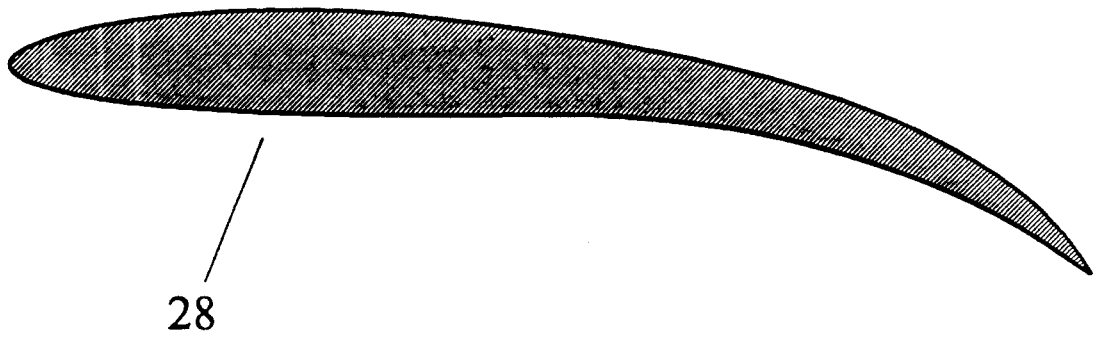
FIG. 3 is a profile of a specific hydrofoil section with a highly cambered trailing edge. This section is particularly good for bubble shedding.

FIG. 3 shows a specific, preferred canard profile 28.

OPERATION OF THE INVENTION

The advantages of my hydrofoil sailboard over previous ones derive principally from my development of hydrofoils that quickly and reliably shed air bubbles, and which are therefore immune to plunging. These foils can track the water surface effectively. Effective surface tracking, particularly of the canard in a canard configured hydrofoil craft, allows craft designs that enjoy simplicity, efficient main foil use, high pitch stability, and excellent performance in waves.

Experimentation I have done shows that air bubble shedding can be accomplished simply by appropriate design of hydrofoil profile. Profile 28 shown in FIG. 3 has proven in practice to be most effective. The high degree of camber near the trailing edge of that profile is the critical feature. When appropriately loaded, and when carefully adjusted to an appropriate angle of attack, a foil built to profile 28 behaves in the following way: At low speed, and starting fully submerged, the foil rises to the surface. On arrival there, the foil top becomes momentarily unwet, and the foil immediately drops a very short distance. As it does, a surface wave forms along the foil leading edge and a depression forms behind the trailing edge. This wave immediately washes over the top of the foil in a thin sheet, joining the water passing below the foil at the trailing edge depression. In flat water, the foil rides stably in this way. If it is subsequently more heavily loaded, the foil finds a new, somewhat lower, stable position, with a thicker sheet of water washing over its top surface. As the foil is progressively lowered in this way, the surface displacements become less pronounced, and ultimately disappear. Thus the behavior of the foil is a clean illustration of the surface effect discussed in the prior art section. It is notable that bubble shedding is effectively instantaneous. This foil goes from hydroplaning to fully submerged very smoothly, with no perceptible intermediate bubble stage.

At higher speeds, the foil built with profile 28 comes to the surface more rapidly as would be expected. When it gets there, it rides in a true hydroplaning mode, with its top surface unwet. In this mode, the foil leading edge shears off a sheet of water that can rise to amazing heights. The surface planing is stable to increased foil loading.

At still higher speeds, the foil, having come to the surface, rides on its trailing edge alone. In this mode, no water at all flies over the foil. Instead, a highly turbulent boil flares, forward and to the side, and substantially parallel to the water surface, from under the foil. In this mode the foil is very stable to additional loading.

If, in either of the two later speed ranges, the foil runs into a wave and submerges, it drives powerfully up to the surface.

The dynamic behavior just described can be used to obvious advantage in a hydrofoil meant to track the water surface. Thus, a hydrofoil built with profile 28 is appropriate for surface tracking. In fact, hydrofoils having profile 28, or having a similar profile characterized by a high degree of camber near the trailing edge, may be best used for surface tracking. Such foils, riding in a fully submerged mode, suffer high drag. When they come to the surface, however, and especially when riding there at very high speed, their drag decreases significantly.

I remark again that profile 28 is particularly efficacious. Other, similarly highly cambered sections, although much better than uncambered foils, do not shed bubbles as well as profile 28.

In my hydrofoil sailboard, I make use of the strong surface tracking just described by incorporating profile 28 into canard hydrofoil 16. I minimize the drag disadvantage of profile 28 by making hydrofoil 16 small and lightly loaded.

Reliable surface tracking by canard hydrofoil 16 allows me to design main hydrofoil 14 to operate fully submerged, and to carry most of the combined weight of the hydrofoil sailboard and sailor.

For the preferred embodiment of my invention, in cruising operation, canard hydrofoil 16 rides at the water surface in an attitude that lets it provide an excess of lift, by which I mean that additional loading will not cause hydrofoil 16 to sink appreciably. Since even with all load removed, hydrofoil 16 will not rise completely above the water surface, it is easy to maintain a significant lift excess. Main hydrofoil 12 is designed to trail at the height determined by the requirement that the lift produced by it supports the part of the combined weight of the sailor and hydrofoil sailboard that is not supported by canard hydrofoil 16. Ideally, the sailor adjusts his or her position so that this attitude yields the minimum drag possible for main foil assembly 8 at the speed of the moment. The length difference between canard support 18 and main support 14 is chosen so that in this cruising condition main hydrofoil 12 is well submerged. Hydrofoil 12 flies more efficiently if it is further from the water surface, avoiding surface loss-of-lift effects and wave making. A traditional efficient, low lift, low drag section is used for hydrofoil 12. Too great an immersion of hydrofoil 12 is avoided since it means more drag from its support 14. The absolute lengths of the support 14 and 18 are chosen large enough so board 4 flies sufficiently clear of the water surface that it only infrequently runs into waves, and the lengths are chosen small enough that the roll-rate to torque ratio does not get out of hand, or that structural strength problems occur.

An advantage of the operation of my invention as described in the previous paragraph, is that with fixed sailor position, and with increasing speed, main hydrofoil 12 approaches a limiting height. This is a very stable situation. A second advantage is that wake interference from canard hydrofoil 16 on main hydrofoil 12 is eliminated.

Excess lift from canard hydrofoil 16, together with the large horizontal distance between it and main hydrofoil 12 lead to good pitch stability.

Other important advantages of my hydrofoil sailboard over previous ones derive from the ability of streamlined fairing 24 to swivel on canard support rod 22.

The purpose of the swiveling for my invention is to allow, during operation, fairing 24 to align itself with the water flowing past it, and thereby eliminate, as nearly as possible, lateral resistance at the bow when the sailboard is moving in yaw. This is the same purpose as that of the more complicated swiveling canard assembly disclosed by Hubbard, and separately, by Cline. A second purpose, which is important for my hydrofoil sailboard, and which is also fulfilled by the swiveling canard assemblies of Hubbard and Cline, but is not mentioned by either, is that canard support 18 by not lifting laterally, provides the weakest possible ventilation path along its outside to canard hydrofoil 16. In order to consolidate this advantage in the case of my swiveling streamlined fairing 24, fairing 24 must be sealed to the rod in such a way that no air can travel along the inside the streamliner to the canard. Seal 26 does the job.

As a result of the swiveling of fairing 24, the only foil elements of my hydrofoil sailboard that are affected by yaw (only main support 14, and main hydrofoil 12 itself if it is built with dihedral or anhedral) are clustered at the position of main foil 12. Consequently the location of the center of lateral resistance of the entire craft is held rather constant in spite of varying immersion of supports 14 and 18. This makes steering much more predictable. Similar observations were made by Hubbard and Cline.

Another result of the swiveling of fairing 24 is dynamic roll stabilization of the hydrofoil sailboard. This is the same benefit that Cline claims from his swiveling canard assembly. It is obtained in my invention in a mechanically simpler and more robust way by the combination of swiveling fairing 24 and fixed main support 14. Cline's method is more effective than mine, but mine is adequate for my purpose.

The principal constraint that distinguishes the design of sail driven craft from those powered by motors is the fact that, except when they are running straight down wind, sail powered vessels must always compensate for a significant lateral force component. This is as true for craft supported by hydrofoils as by any other means. I shall show below, that for my hydrofoil sailboard, the compensation can be accomplished simply by maintaining the board rolled to weather by an appropriate amount. This fixed amount of roll does not invalidate the discussion of other aspects of control discussed above.

During operation under sail and when board 4 is free of the water, main hydrofoil 12, canard hydrofoil 16, and main support 14, (but not canard support 18 which swivels) resist lateral forces from the sail. If board 4 is sailed flat, main support 14 provides all the resistance. As board 4 is rolled to weather, the contribution to the resistance from support 14 decreases, and the combined contribution from hydrofoils 12 and 16 increases. At a particular roll angle that depends on speed, and combined sailor and sailboard hydrofoil weight, the contribution from support 14 is zero. This is the optimum operating angle for my hydrofoil sailboard. At this angle, main support 14, which is surface piercing, is not operating in yaw, so its tendency to ventilate, and thus to ventilate main hydrofoil 12 is minimal. This is an important advantage which is not appreciated in the prior hydrofoil sailboard art. All previous hydrofoil sailboards include extra fins or daggerboards, presumably to resist lateral sail force. None of the designs makes provision for preventing ventilation of these extra appendages.

My experience in actual operation is that, even with my design operating at optimum roll, there is a speed above which, if main support ventilation fences 20 are omitted, adventitious departures from zero yaw cause main support 14 to ventilate, and the entire craft to lose yaw stability to the extent that it becomes completely uncontrollable. Placement of fences 20, however, solves the problem.

When sailed at optimum roll, the center of lateral resistance of the entire craft coincides with the center of vertical lift, and with fore-and-aft position of the center of mass of the combined system of sailor and craft, which, since the sailboard hydrofoil is so light, is pretty much the position of the sailor. Thus, for the hydrofoil sailboard and sail to be in balance, the sail must be positioned so that it provides no turning torque about that center. This is different from the lateral balance situation that arises for modern sailboards, and means that conventional sails must be used in a somewhat unusual manner on my hydrofoil sailboard, as described below.

These days, high-performance sailboards have eliminated the historical centrally located daggerboard, and use only a single skeg at the very back of the board to resist lateral force. Thus, their center of lateral resistance is always aft of the center of buoyancy, which is close to the sailor's center of mass. To bring the center of lift forward, as is required by my hydrofoil sailboard, the sail must be raked forward further than is usual for conventional sailboards. This forward rake is most appropriately accomplished in conjunction with moving the mast foot aft. Sails designed for use with my hydrofoil sailboard would have a squarer foot than is now customary, so that the slot between the lower edge of the sail and board 4 is be closed in the more forward raked sail attitude.

Next I give further operational details.

In low speed operation, my hydrofoil sailboard works like an ordinary sailboard. As the speed increases, the foils take over an increasing share of the lift, until, at takeoff speed they lift the board completely free of the water. At all speeds the invention is controlled in substantially the same way, by adjustment of the sailor's center of mass and by alteration of sail position.

The details of the profiles, planforms, and rigging angles of main hydrofoil 12 and canard hydrofoil 16 are chosen according to the prior art so that with both hydrofoils 12 and 16 fully submerged, the craft is attitude stable. For takeoff, the sailor assumes a position aft of that for full flying, but in front of the center of lift of main foil hydrofoil 12. This causes canard hydrofoil 16 to lift proportionally more than the main hydrofoil 12 and the bow rises. The sailor maintains the aft position as the canard hydrofoil 16 comes to the surface. In the absence of the plunging instability, canard hydrofoil 16 stays at the surface, and the main hydrofoil 12 rises. Up to a point, the more it rises, especially as the board 4 itself clears the water, the less drag and the faster the craft goes. The increased speed allows more rise. As the speed increases, the sailor can move further forward to increase the load on canard hydrofoil 16, always maintaining excess canard lift so that the hydrofoil 16 stays on the surface. Eventually cruising attitude and speed are reached. As hydrofoils 12 and 16 begin to lift, board 4 is rolled to weather to carry sail side force.

Just as in high-performance boardsailing, rolling is the preferred method of turning. This works for my hydrofoil sailboard just as it does for other hydrofoil craft. Hubbard's explanation is excellent.

When sailing in waves, my hydrofoil sailboard is meant to be sailed so that canard hydrofoil 16 drives through wave crests, alternately being fully submerged and completely airborne. This method of operation allows main hydrofoil 12 to keep a more constant height than it would if hydrofoil 16 always stayed precisely on the surface. The more lightly canard hydrofoil 16 is loaded, the more closely it will track the surface. The sailor should choose a loading that is appropriate to the conditions at hand.

This completes the description and discussion of operation of the preferred embodiment of my hydrofoil sailboard.

Figure 2:
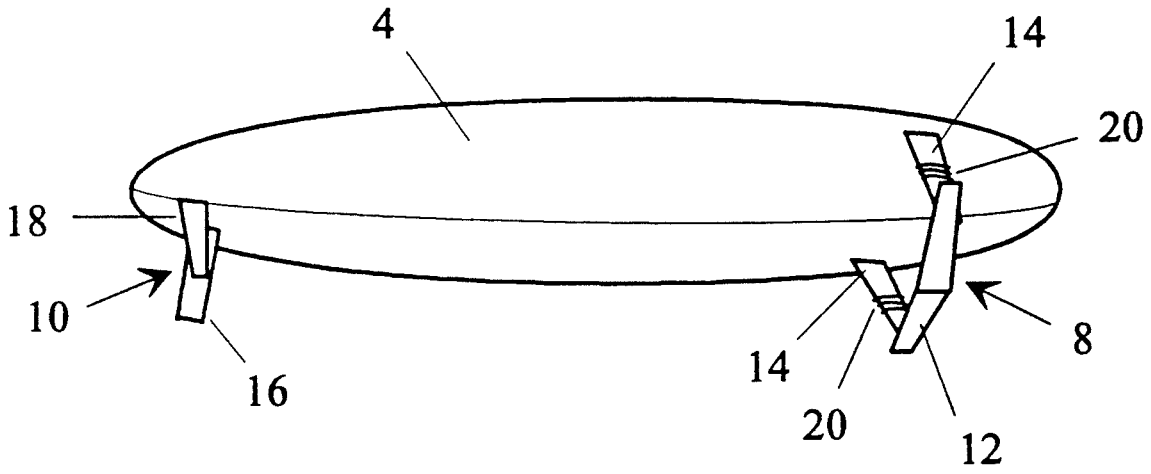
FIG. 2 is a perspective view from the side and below of a canard configured hydrofoil sailboard having two main supports.

FIG. 2 shows a ramification of the present invention in which two main supports 14 are used. This has considerable structural advantage, and, especially in the case that main hydrofoil 12 has small span, the endplate effect from supports 14 is helpful at high lift coefficients encountered during takeoff. Against these advantages are balanced increased drag from having two supports, and susceptibility to a yaw instability caused by differential immersion of the two supports. The former effect is small, and the latter, which is proportional to the square of the distance between the supports is not a problem for distances on the order of a board width.

Figure 4:
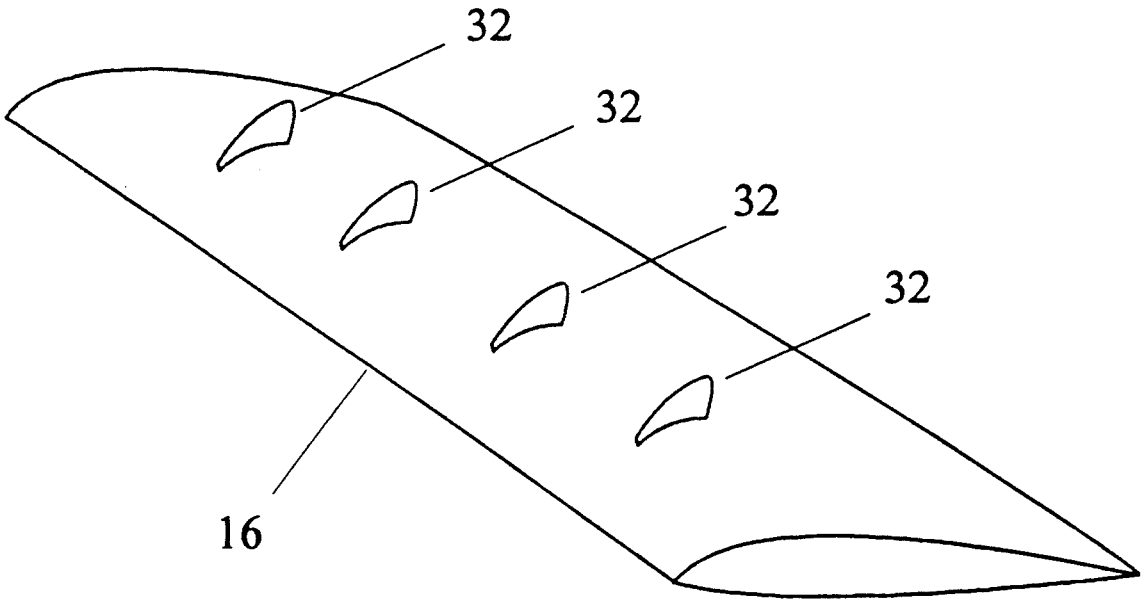
FIG. 4 is a perspective view of a hydrofoil with protrusions to effect bubble shedding.
Figure 5:
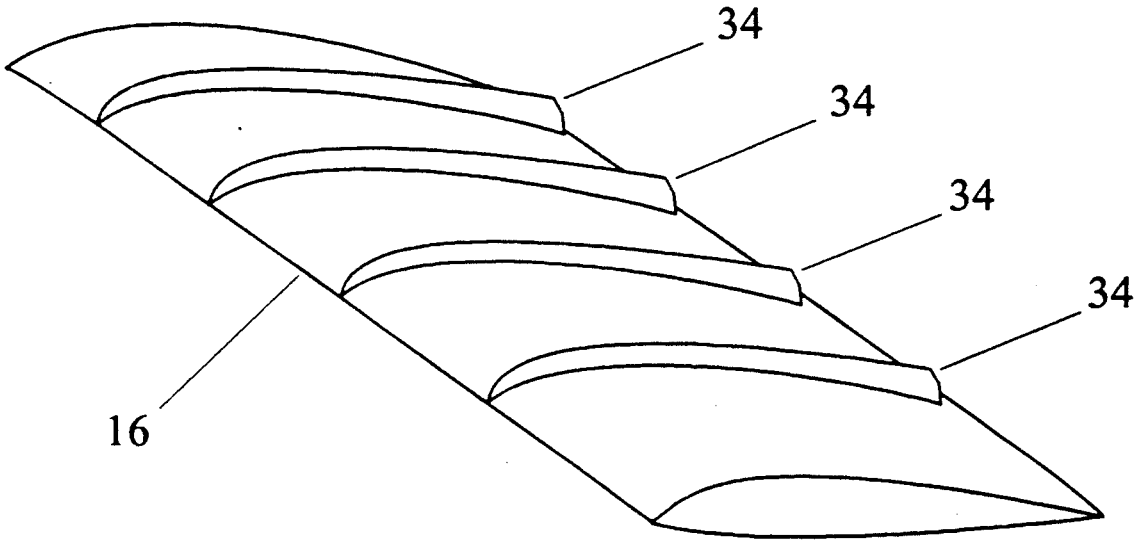
FIG. 5 is a perspective view of a hydrofoil with fences to effect bubble shedding.
Figure 6:
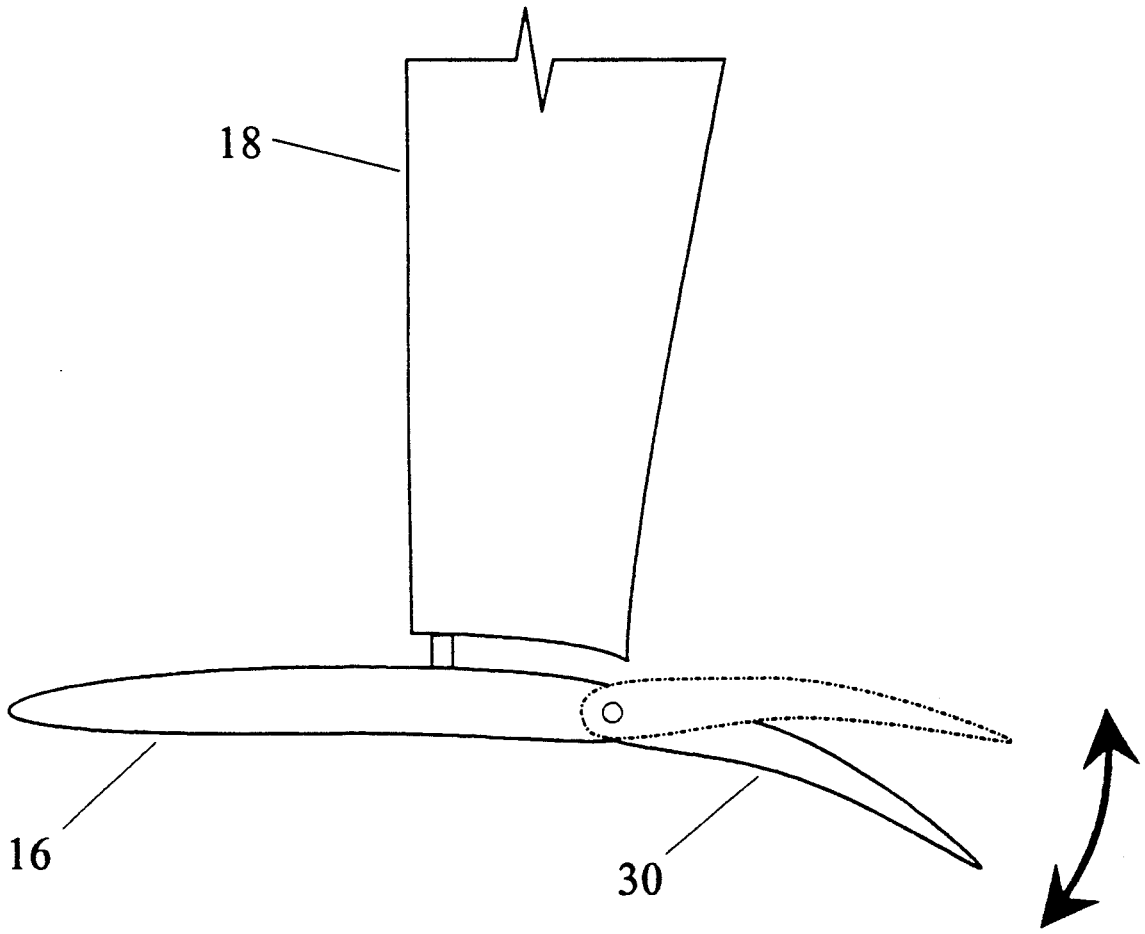
FIG. 6 is a side view of a hydrofoil with a downward deflectable trailing edge flap.
Figure 7:
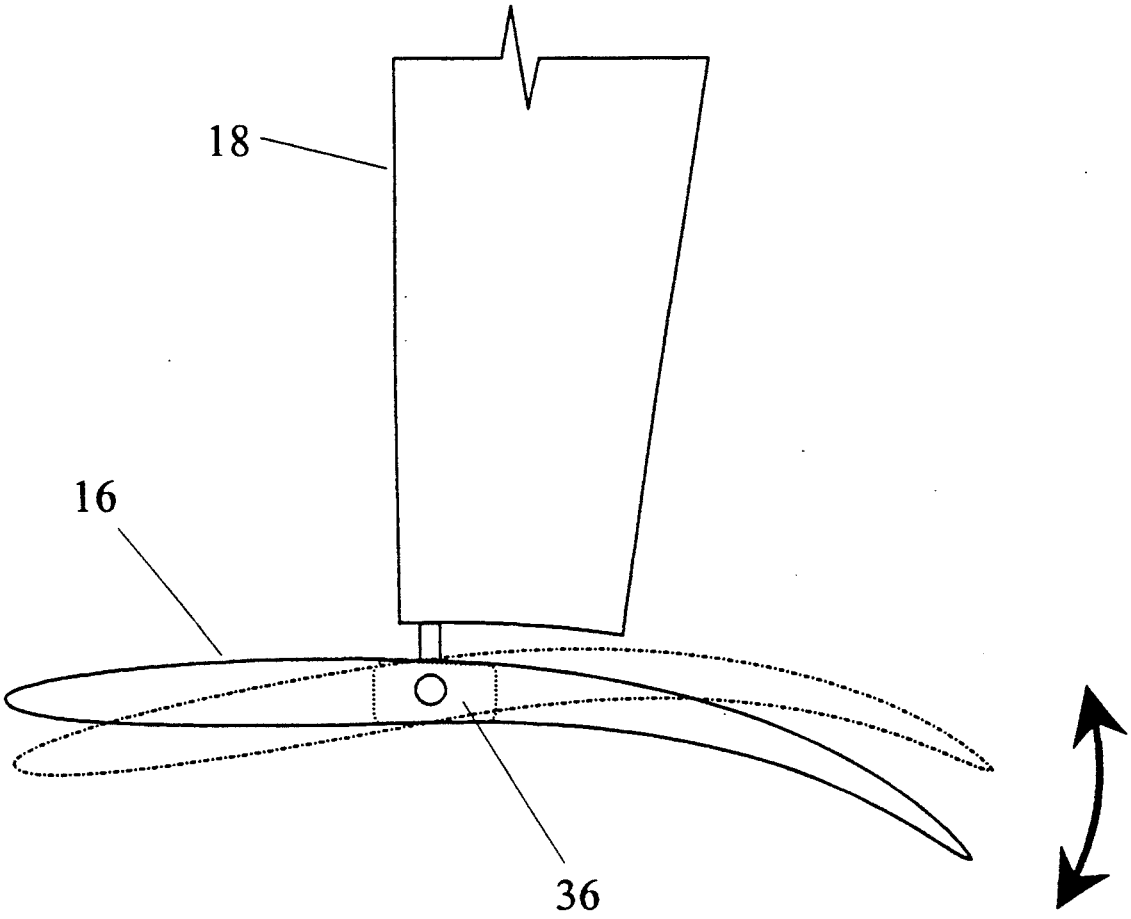
FIG. 7 is a side view of a hydrofoil able to flick to a lower angle of attack.

FIGS. 4, 5, 6, and 7 show four alternate means of mitigating the plunging instability. FIG. 4 shows a number of protrusions 32 attached to the upper surface of canard hydrofoil 16. Such protrusions help to reduce plunging by breaking an air bubble into a number of smaller ones which trail in the protrusion wakes. This effectively sheds the bubble from at least some of the surface of hydrofoil 16 allowing it to lift more strongly. The bubbles hanging off the protrusions are more exposed to water flow, and dissipate more rapidly. FIG. 5 shows a number of upper surface fences 34 that have the same sort of effect as the protrusions 32. The fences generally work better than the protrusions. FIGS. 6 and 7 show the general shape and operation of two mechanical devices for shedding air bubbles. They both make use of my observation that bubbles tend to shed very rapidly from relatively uncambered foils when such foils operate at zero lift. In each device, the mechanism detects the loss in lift at the onset of a plunge, and in the configuration shown in FIG. 6, momentarily flicks up a trailing edge flap 30, and in the configuration shown in FIG. 7, momentarily flicks canard hydrofoil 16 as a whole to lower attack. Both mechanisms shed the bubble and return to high lift before the bow can drop significantly. Specific flicking mechanisms can easily be designed by anyone knowledgable in the art of mechanical linkages. Use of the mechanism shown in FIG. 7 might be appropriate for high speed operation where a highly cambered canard might be too radical.

Figure 10:
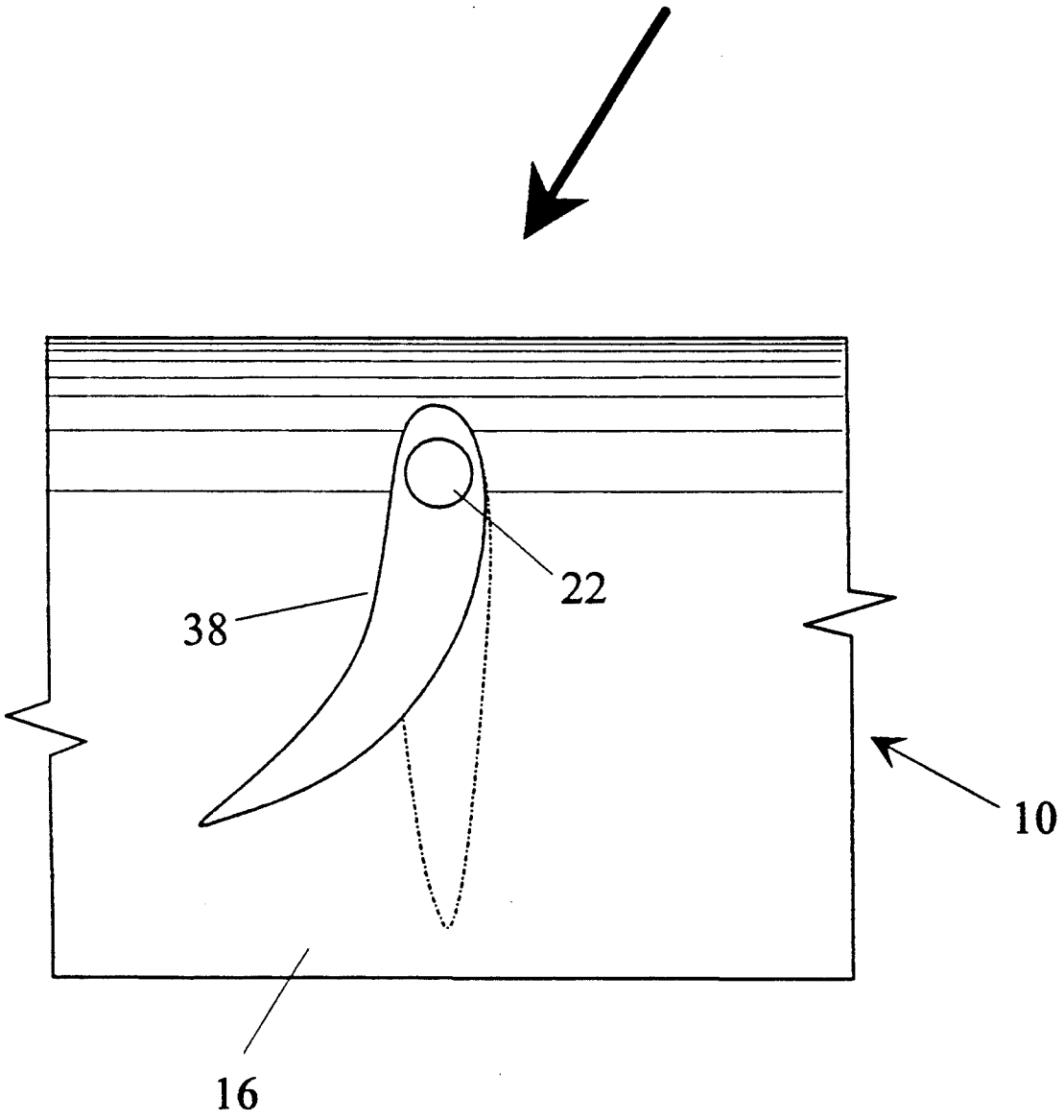
FIG. 10 is a top view of a canard hydrofoil assembly showing a flexible fairing fitted to a support.

FIG. 10 shows a variant on the canard assembly 10 shown in FIGS. 8 and 9. In the variant, rod 22 is fitted with a flexible streamlined fairing that is able to deform as shown in FIG. 10 to deform to the water flowing past it. In FIG. 10 the heavy arrow indicates the direction of water flow.

Figure 11:
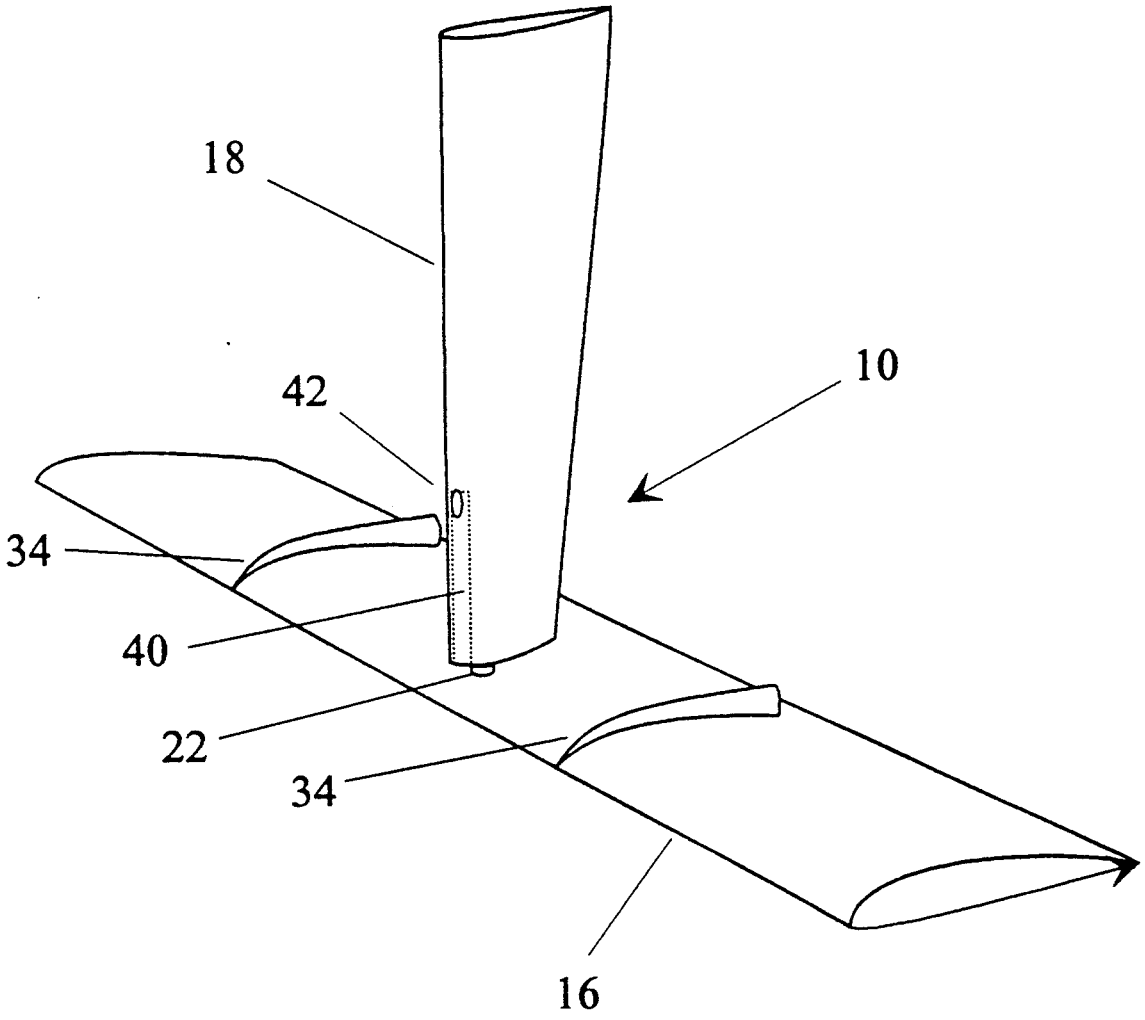
FIG. 11 is a perspective view of a canard hydrofoil assembly showing a support containing an air passage.

FIG. 11 shows the canard assembly 10 of FIG. 8 with the addition of an air passage 40 that could be used as part of a scheme to maintain canard hydrofoil 16 at particular depth below the water surface. It would work this way: when hydrofoil 16 is near the water surface, an air intake 42 is exposed to the atmosphere, and passage 40 allows ventilation from intake 42 to the bottom of fairing 24, whence the ventilating air escapes onto the top surface of canard hydrofoil 16. Such air flow would form a bubble on the portion of the top of hydrofoil 16 between the two fences 34, causing a limited reduction in lift. In response to the loss in lift, canard hydrofoil 16 would drop, moving intake 42 under water. By suitable choice of passage size, and using the fact that water is more viscous than air, passage 40 would effectively be blocked. If hydrofoil 16 is able to shed the bubble very rapidly after this closing, the descent of hydrofoil 16 would stop. The key to the success of this scheme is the very rapid bubble shedding.

Figure 12:
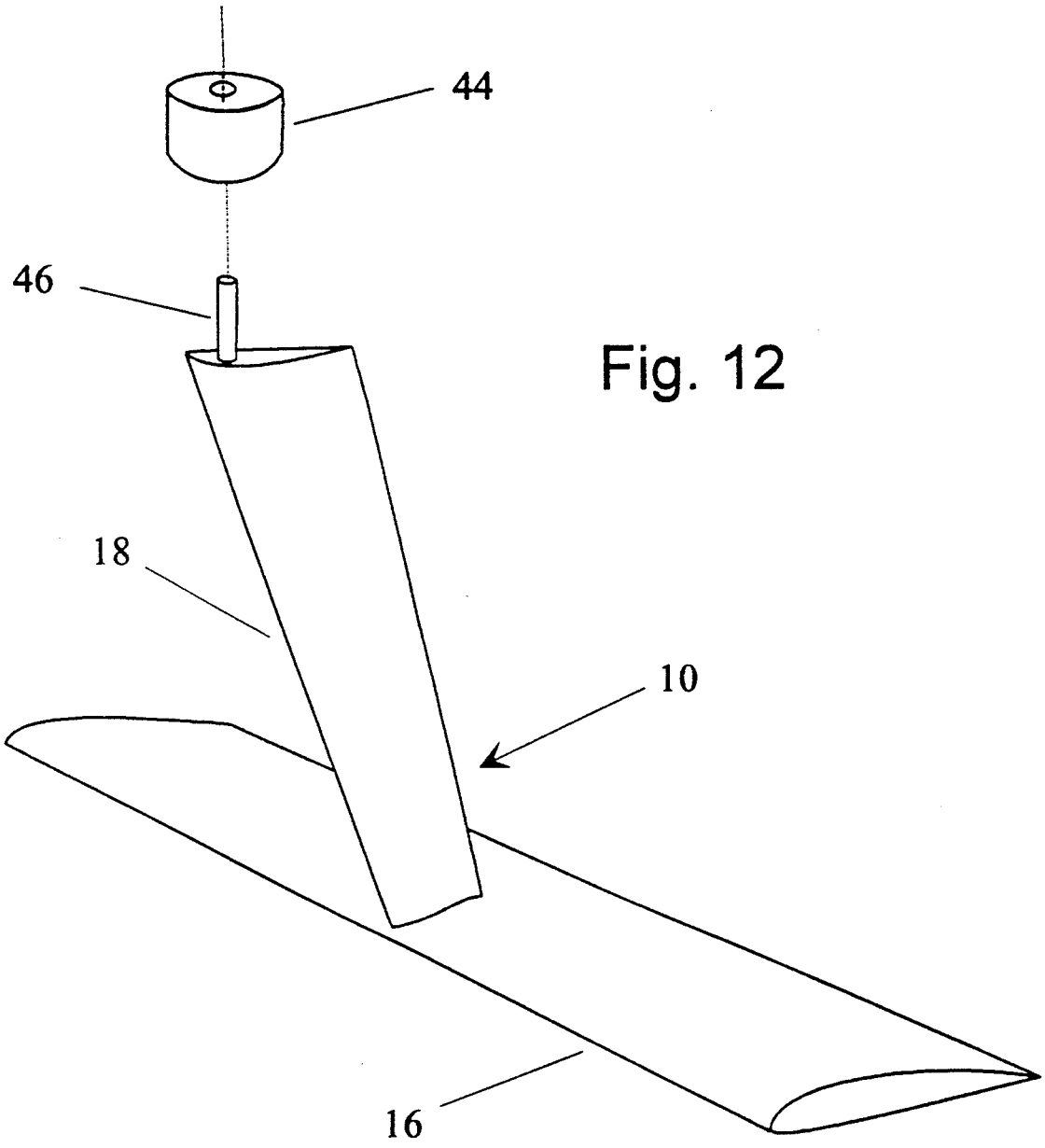
FIG. 12 is a perspective view of a canard hydrofoil assembly that rotates as a unit.

FIG. 12 shows a canard assembly like Hubbard's that could be used in place of the preferred one shown in FIG. 8. Canard support 18 is attached to board 4 by a shaft 46 and a bearing 44.

Finally, one can imagine might dispensing with the canard hydrofoil 16 entirely, and using instead a planing float that has significant static buoyancy. However, in waves, that would lead to major changes in drag, and a rather jarring ride. In any case, such a float would have to swivel for the same reasons that the fairing 24 must.

The foils can be either permanently mounted on the board, or, more desirably, be removable. A convenient method of attachment is to equip the board with the standardized heavy-duty sailboard fin boxes that are now available, and insert the appropriately shaped tops of the main foil supports into them. Another box can be mounted in the how for the canard support. Although the main supports may as well mount in a fixed position, it is a good idea to allow the canard support angle to be adjustable for fine tuning the canard rigging angle.

While there has been described what is at present considered to be the preferred embodiments of this invention, it will be obvious to those skilled in the art that various changes and modifications may be made therein without departing from the invention, and it is, therefore, aimed in the appended claims to cover all such changes and modifications as fall within the true spirit and scope of the invention.

I claim:

1. A sail powered watercraft comprising:

(a) a sailboard hull, a sail assembly, and sail attachment means for joining said sail assembly to said sailboard hull (b) a main hydrofoil assembly comprising a main hydrofoil and main support means for mounting said main hydrofoil to said sailboard hull at a location rearward from the location of said sail attachment means (c) a canard hydrofoil assembly comprising a canard hydrofoil and canard support means for mounting said canard hydrofoil to said sailboard hull at a location forward from the location of said sail attachment means (d) said canard hydrofoil assembly comprising bubble shedding means for quickly removing air bubbles that may lodge on said hydrofoil during operation, whereby plunging may be inhibited and whereby lift from said canard hydrofoil may be controlled.

2. The sail powered watercraft of claim 1 wherein said main support means and said canard support means are sized so as to position said main hydrofoil a predetermined amount lower than said canard hydrofoil when said sailboard hull is oriented upright and substantially horizontally, whereby in normal operation when said canard hydrofoil rides at the water surface said main hydrofoil rides below the water surface.

3. The sail powered watercraft of claim 1 further including passage means for allowing air to flow through said canard support means from a location a predetermined height above said canard hydrofoil to the location of said canard hydrofoil, whereby during operation and in conjunction with the functioning of said bubble shedding means the lift provided by said canard hydrofoil will automatically vary in such a way that said canard hydrofoil will ride at a predetermined depth.

4. A sail powered watercraft comprising:

(a) a sailboard hull, a sail assembly, and sail attachment means for joining said sail assembly to said sailboard hull (b) a main hydrofoil assembly comprising a main hydrofoil and main support means for mounting said main hydrofoil to said sailboard hull at a location rearward from the location of said sail attachment means (c) a canard hydrofoil assembly comprising a canard hydrofoil and canard support means for mounting said canard hydrofoil to said sailboard hull at a location forward from the location of said sail attachment means (d) fairing means for smoothing water flow past said canard support means (e) said fairing means being conformable so as to be able to substantially align with water flow past said fairing means during operation, whereby steerability and yaw stability of said watercraft are enhanced and whereby ventilation of said canard hydrofoil by air flow along the outside of said fairing means is inhibited.

5. The sail powered watercraft of claim 4 wherein said canard support means comprises a foil shaped strut, and wherein said canard support means is rigidly joined to said canard hydrofoil and rotationally attached to said sailboard hull by bearing means for allowing said canard hydrofoil and said canard support means to jointly rotate so that during operation said foil shaped strut freely trails to align with water flow past it.

6. A hydrofoil assembly for a watercraft comprising:

(a) a hydrofoil (b) support means for connecting said hydrofoil to said watercraft (c) fairing means for smoothing water flow past said support means (d) said fairing means being conformable so as to be able to substantially align with the water flow past said fairing means during operation, whereby steerability and yaw stability of said watercraft are enhanced and whereby ventilation of said hydrofoil by air flow along the outside of said fairing means is inhibited (e) said support means comprising a support rod (f) said fairing means comprising a foil shaped fairing surrounding said support rod, said foil shaped fairing mounted so as to swivel freely on said support rod (g) sealing means for inhibiting undesired flow of air between said foil shaped fairing and said support rod during operation.

7. A hydrofoil assembly for a watercraft comprising:

(a) a hydrofoil (b) support means for connecting said hydrofoil to said watercraft (c) fairing means for smoothing water flow past said support means (d) said fairing means comprising a foil shaped fairing made of flexible material, said foil shaped fairing fitted to said support means in such a manner that during operation said foil shaped fairing deforms so as to substantially align with water flow past said foil shaped fairing, whereby steerability and yaw stability of said watercraft are enhanced and whereby ventilation of said hydrofoil by air flow along the outside of said fairing means is inhibited.

8. A hydrofoil assemble for a watercraft comprising:

(a) a hydrofoil and (b) bubble shedding means for quickly removing air bubbles that may lodge on said hydrofoil during operation, where said bubble shedding means comprises means for momentarily flicking said hydrofoil to a lower angle of attack.

* * * * *